US007289951B1

(12) United States Patent
Ojanperaå

(10) Patent No.: US 7,289,951 B1
(45) Date of Patent: Oct. 30, 2007

(54) METHOD FOR IMPROVING THE CODING EFFICIENCY OF AN AUDIO SIGNAL

(75) Inventor: Juha Ojanperaå, Tampere (FI)

(73) Assignee: Nokia Corporation, Espoo (FI)

( * ) Notice: Subject to any disclaimer, the term of this patent is extended or adjusted under 35 U.S.C. 154(b) by 554 days.

(21) Appl. No.: 09/610,461

(22) Filed: Jul. 5, 2000

(30) Foreign Application Priority Data

Jul. 5, 1999 (FI) ..... 991537

(51) Int. Cl.
*G10L 11/04* (2006.01)

(52) U.S. Cl. ..... 704/207; 704/206

(58) Field of Classification Search ..... 704/207
See application file for complete search history.

(56) References Cited

U.S. PATENT DOCUMENTS

| | | | | |
|---|---|---|---|---|
| 5,321,793 | A | 6/1994 | Drogo De Iacovo et al. | 395/2.29 |
| 5,528,629 | A | 6/1996 | Van der Krogt et al. | 375/244 |
| 5,596,677 | A | 1/1997 | Jarvinen et al. | 395/2.29 |
| 5,611,019 | A * | 3/1997 | Nakatoh et al. | 704/233 |
| 5,765,127 | A * | 6/1998 | Nishiguchi et al. | 704/208 |
| 5,784,631 | A * | 7/1998 | Wise | 341/65 |
| 5,819,212 | A * | 10/1998 | Matsumoto et al. | 704/200.1 |
| 5,864,798 | A * | 1/1999 | Miseki et al. | 704/225 |
| 5,983,173 | A * | 11/1999 | Inoue et al. | 704/208 |
| RE36,721 | E * | 5/2000 | Akamine et al. | 704/220 |
| 6,101,464 | A * | 8/2000 | Serizawa | 704/219 |
| 6,202,046 | B1 * | 3/2001 | Oshikiri et al. | 704/233 |
| 6,243,672 | B1 * | 6/2001 | Iijima et al. | 704/207 |
| 6,351,730 | B2 * | 2/2002 | Chen | 704/219 |
| 6,453,288 | B1 * | 9/2002 | Yasunaga et al. | 704/223 |
| 6,493,665 | B1 * | 12/2002 | Su et al. | 704/230 |
| 6,691,084 | B2 * | 2/2004 | Manjunath et al. | 704/221 |

FOREIGN PATENT DOCUMENTS

| | | |
|---|---|---|
| CA | 2021514 | 3/1991 |
| CA | 2124643 | 12/1994 |

(Continued)

OTHER PUBLICATIONS

McClellan, et al., "Efficient Pitch Filter encoding for Variable Rate Speech Processing", IEEE Transactions on Speech and Audio Processing, vol. 7, No. 1, Jan. 1999, pp. 18-29.

*Primary Examiner*—Vijay Chawan
*Assistant Examiner*—Michael N. Opsasnick

(57) ABSTRACT

The invention relates to a method for improving the coding accuracy and transmission efficiency of an audio signal. According to the method, a part of the audio signal to be coded is compared with earlier stored samples of the audio signal and a reference sequence of samples that best corresponds to the audio signal to be coded is identified. Predicted signals are produced from the reference sequence by means of long-term prediction, using at least two different LTP orders (M), a group of pitch predictor coefficients (b(k)) being formed for each pitch predictor order. The predicted signals for each pitch predictor order are compared with the audio signal to be coded in order to determine a prediction error. The amount of information required to code the predicted signals is compared with the amount of information required to code the original signal and a coding method that provides the best representation of the audio signal while minimising the amount of data required is selected.

54 Claims, 5 Drawing Sheets

FOREIGN PATENT DOCUMENTS

Figure 1:
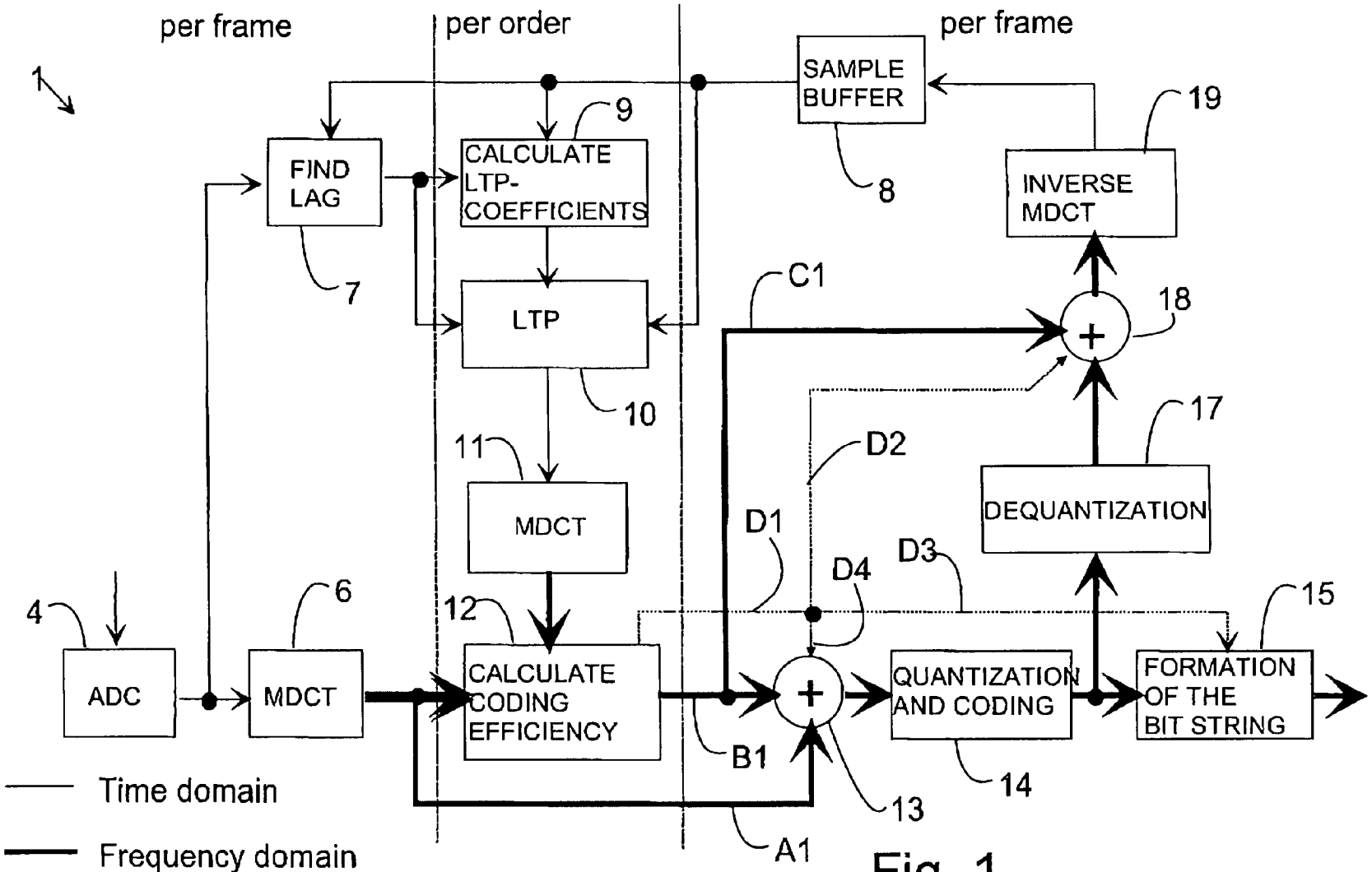

| | | | |
|---|---|---|---|
| EP | 0 475 520 | A2 | 3/1992 |
| EP | 0 582 921 | A2 | 2/1994 |
| JP | 5-268098 | | 10/1993 |
| JP | 7-336232 | | 12/1995 |
| JP | 08166800 | A | 6/1996 |
| JP | 8-171400 | | 7/1996 |
| JP | 11-177434 | | 7/1999 |
| WO | WO 99/18565 | A2 | 4/1999 |
| WO | WO 99/18565 | A3 | 4/1999 |

* cited by examiner

METHOD FOR IMPROVING THE CODING EFFICIENCY OF AN AUDIO SIGNAL

The present invention relates to a method according to the preamble of the appended claim 1 for improving the coding efficiency of an audio signal. The invention also relates to a data transmission system according to the appended claim 21, to an encoder according to the preamble of the appended claim 27, to a decoder according to the preamble of the appended claim 30, and to a decoding method according to the preamble of the appended claim 38.

In general, audio coding systems produce coded signals from an analog audio signal, such as a speech signal. Typically, the coded signals are transmitted to a receiver by means of data transmission methods specific to the data transmission system. In the receiver, an audio signal is produced on the basis of the coded signals. The amount of information to be transmitted is affected e.g. by the bandwidth used for the coded information in the system, as well as by the efficiency with which the coding can be executed.

For the purpose of coding, digital samples are produced from the analog signal e.g. at regular intervals of 0.125 ms. The samples are typically processed in groups of a fixed size, for example in groups having a duration of approximately 20 ms. These groups of samples are also referred to as "frames". Generally, a frame is the basic unit in which audio data is processed.

The aim of audio coding systems is to produce a sound quality which is as good as possible within the scope of the available bandwidth. To this end, the periodicity present in an audio signal, especially in a speech signal, can be utilized. The periodicity in speech results e.g. from vibrations in the vocal cords. Typically, the period of vibration is in the order of 2 ms to 20 ms. In numerous speech coders according to prior art, a technique known as long-term prediction (LTP) is used, the purpose of which is to evaluate and utilize this periodicity to enhance the efficiency of the coding process. Thus, during encoding, the part (frame) of the signal to be coded is compared with previously coded parts of the signal. If a similar signal is located in the previously coded part, the time delay (lag) between the similar signal and the signal to be coded is examined. A predicted signal representing the signal to be coded is formed on the basis of the similar signal. In addition, an error signal is produced, which represents the difference between the predicted signal and the signal to be coded. Thus, coding is advantageously performed in such a way that only the lag information and the error signal are transmitted. In the receiver, the correct samples are retrieved from the memory, used to predict the part of the signal to be coded and combined with the error signal on the basis of the lag. Mathematically, such a pitch predictor can be thought of as performing a filtering operation which can be illustrated by a transfer function, such as that shown below:

$$P(z)=\beta z^{-\alpha}$$

The above equation illustrates the transfer function of a first order pitch predictor. $\beta$ is the coefficient of the pitch predictor and $\alpha$ is the lag representing the periodicity. In the case of higher order pitch predictor filters it is possible to use a more general transfer function:

$$P(z)=\sum_{k=-m_1}^{m_2}\beta_k z^{-(\alpha+k)}$$

The aim is to select coefficients $\beta_k$ for each frame in such a way that the coding error, i.e. the difference between the actual signal and the signal formed using the preceding samples, is as small as possible. Advantageously, those coefficients are selected to be used in the coding with which the smallest error is achieved using the least squares method. Advantageously, the coefficients are updated frame-by-frame.

The U.S. Pat. No. 5,528,629 discloses a prior art speech coding system which employs short-term prediction (STP) as well as first order long-term prediction.

Prior art coders have the disadvantage that no attention is paid to the relationship between the frequency of the audio signal and its periodicity. Thus, the periodicity of the signal cannot be utilized effectively in all situations and the amount of coded information becomes unnecessarily large, or the sound quality of the audio signal reconstructed in the receiver deteriorates.

In some situations, for example, when an audio signal has a highly periodic nature and varies little over time, lag information alone provides a good basis for prediction of the signal. In this situation it is not necessary to use a high order pitch predictor. In certain other situations, the opposite is true. The lag is not necessarily an integer multiple of the sampling interval. For example, it may lie between two successive samples of the audio signal. In this situation, higher order pitch predictors can effectively interpolate between the discrete sampling times, to provide a more accurate representation of the signal. Furthermore, the frequency response of higher order pitch predictors tends to decrease as a function of frequency. This means that higher order pitch predictors provide better modelling of lower frequency components in the audio signal. In speech coding, this is advantageous, as lower frequency components have a more significant influence on the perceived quality of the speech signal than higher frequency components. Therefore, it should be appreciated that the ability to vary the order of pitch predictor used to predict an audio signal in accordance with the evolution of the signal is highly desirable. An encoder that employs a fixed order pitch predictor may be overly complex in some situations, while failing to model the audio signal sufficiently in others.

One purpose of the present invention is to implement a method for improving the coding accuracy and transmission efficiency of audio signals in a data transmission system, in which the audio data is coded to a greater accuracy and transferred with greater efficiency than in methods of prior art. In an encoder according to the invention, the aim is to predict the audio signal to be coded frame-by-frame as accurately as possible, while ensuring that the amount of information to be transmitted remains low. The method according to the present invention is characterized in what is presented in the characterizing part of the appended claim 1. The data transmission system according to the present invention is characterized in what is presented in the characterizing part of the appended claim 21. The encoder according to the present invention is characterized in what is presented in the characterizing part of the appended claim 27. The decoder according to the present invention is characterized in what is presented in the characterizing part of the appended claim 30. Furthermore, the decoding method according to the present invention is characterized in what is presented in the characterizing part of the appended claim 38.

The present invention achieves considerable advantages when compared to solutions according to prior art. The method according to the invention enables an audio signal to be coded more accurately when compared with prior art methods, while ensuring that the amount of information required to represent the coded signal remains low. The invention also allows coding of an audio signal to be performed in a more flexible manner than in methods according to prior art. The invention may be implemented in such a way as to give preference to the accuracy with which the audio signal is predicted (qualitative maximization), to give preference to the reduction of the amount of information required to represent the encoded audio signal (quantitative minimization), or to provide a trade-off between the two. Using the method according to the invention it is also possible to better take into account the periodicities of different frequencies that exist in the audio signal.

Figure 2:
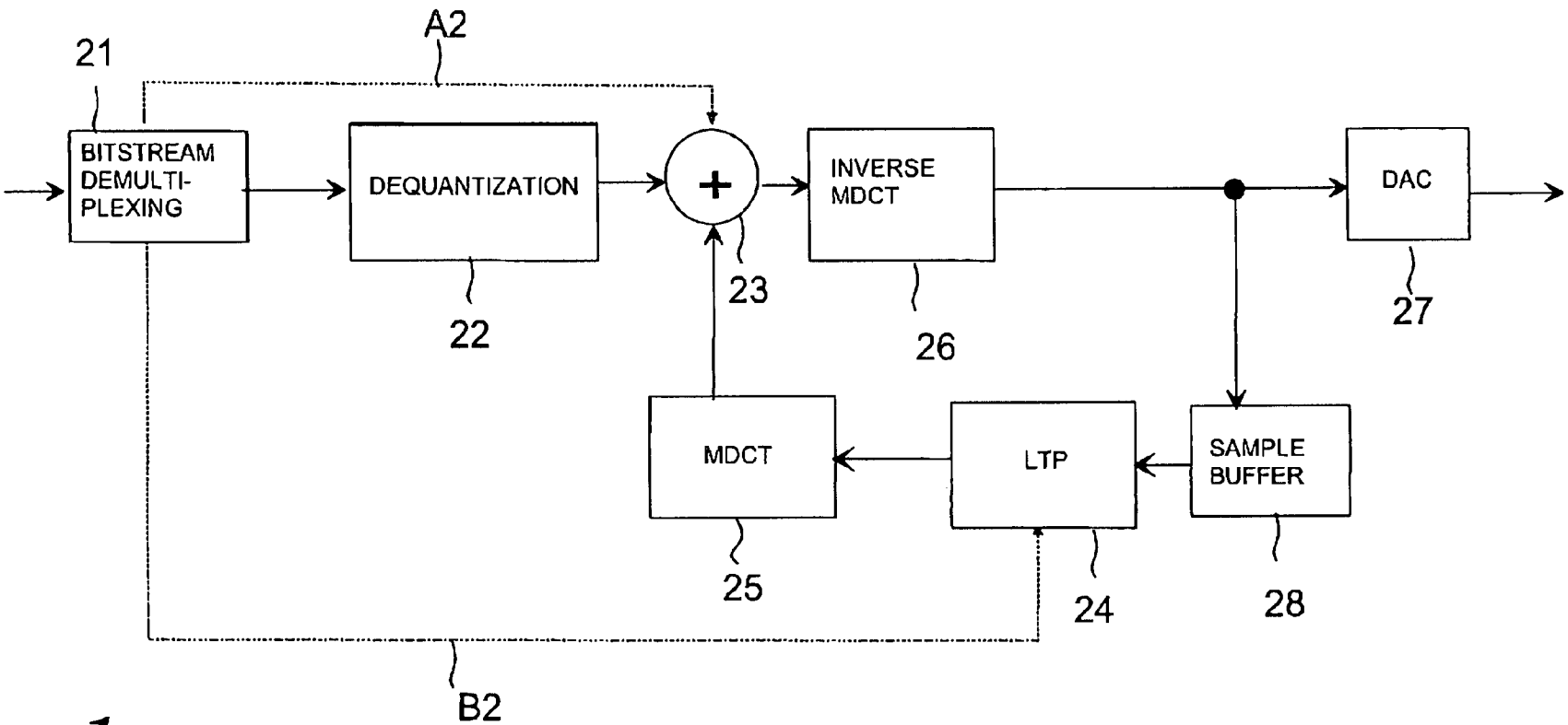
Figure 3:
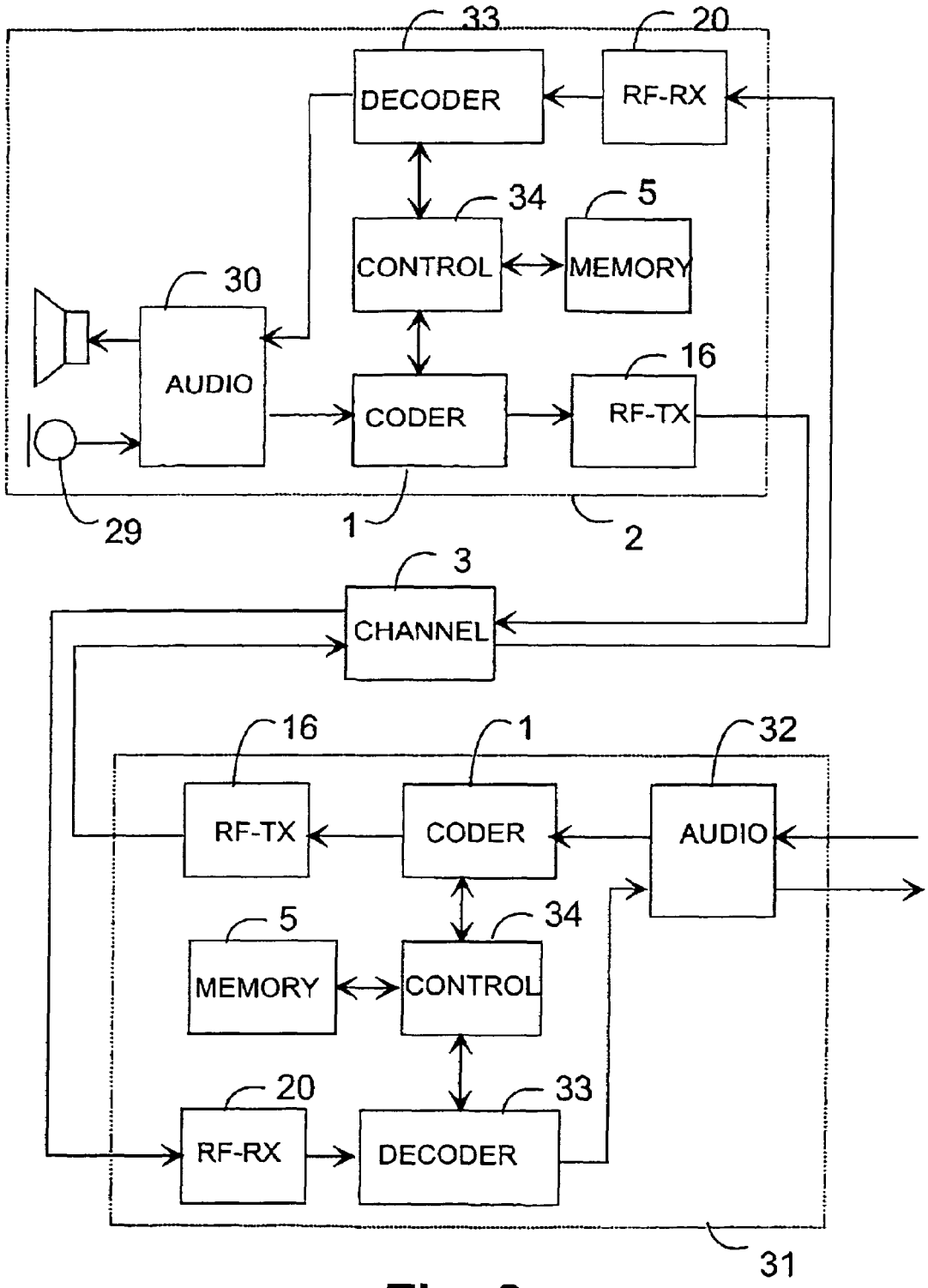
Figure 4:
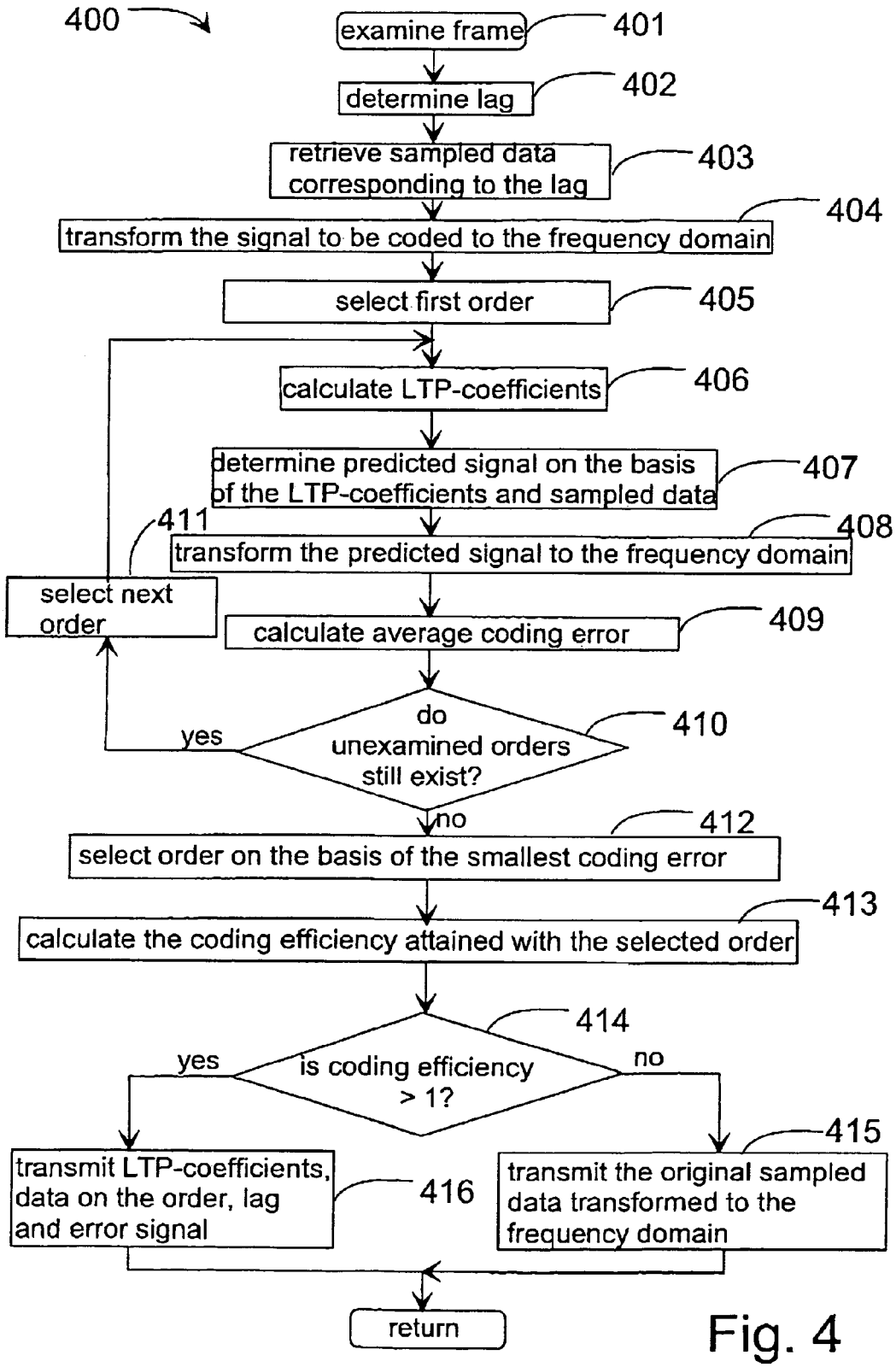
Figure 5A:
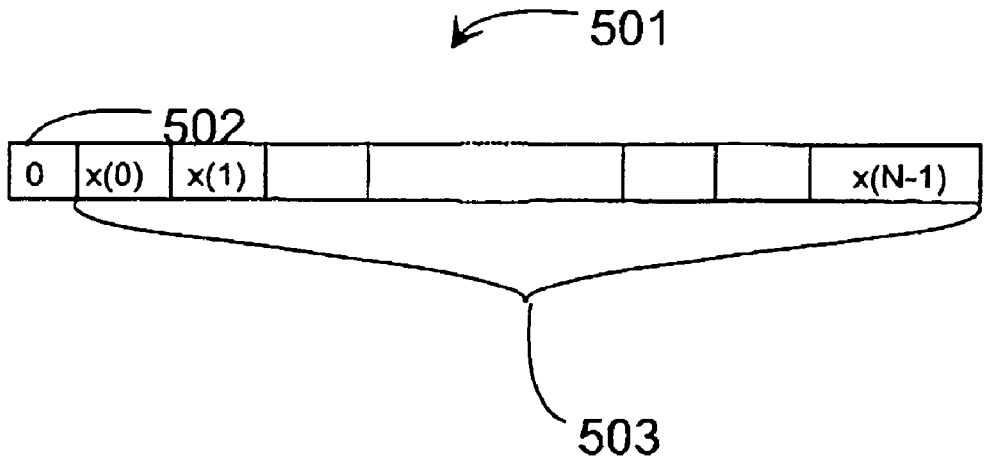
Figure 5B:
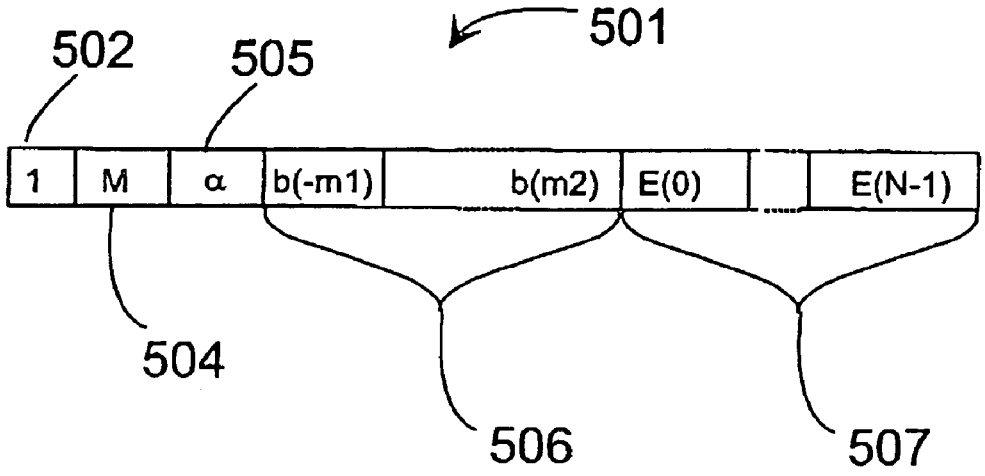

In the following, the invention will be described in more detail with reference to the appended drawings in which FIG. 1 shows an encoder according to a preferred embodiment of the invention, FIG. 2 shows a decoder according to a preferred embodiment of the invention, FIG. 3 is a reduced block diagram presenting a data transmission system according to a preferred embodiment of the invention, FIG. 4 is a flow diagram showing a method according to a preferred embodiment of the invention, and FIGS. 5*a* and 5*b* are examples of data transmission frames generated by the encoder according to a preferred embodiment of the invention.

FIG. 1 is a reduced block diagram showing an encoder 1 according to a preferred embodiment of the invention. FIG. 4 is a flow diagram 400 illustrating the method according to the invention. The encoder 1 is, for example, a speech coder of a wireless communication device 2 (FIG. 3) for converting an audio signal into a coded signal to be transmitted in a data transmission system such as a mobile communication network or the Internet network. Thus, a decoder 33 is advantageously located in a base station of the mobile communication network. Correspondingly, an analog audio signal, e.g. a signal produced by a microphone 29 and amplified in an audio block 30 if necessary, is converted in an analog/digital converter 4 into a digital signal. The accuracy of the conversion is e.g. 8 or 12 bits, and the interval (time resolution) between successive samples is e.g. 0.125 ms. It is obvious that the numerical values presented in this description are only examples clarifying, not restricting the invention.

The samples obtained from the audio signal are stored in a sample buffer (not shown), which can be implemented in a way known as such e.g. in the memory means 5 of the wireless communication device 2. Advantageously, encoding of the audio signal is performed on a frame-by-frame basis such that a predetermined number of samples is transmitted to the encoder 1 to be coded, e.g. the samples produced within a period of 20 ms (=160 samples, assuming a time interval of 0.125 ms between successive samples). The samples of a frame to be coded are advantageously transmitted to a transform block 6, where the audio signal is transformed from the time domain to a transform domain (frequency domain), for example by means of a modified discrete cosine transform (MDCT). The output of the transform block 6 provides a group of values which represent the properties of the transformed signal in the frequency domain. This transformation is represented by block 404 in the flow diagram of FIG. 4.

An alternative implementation for transforming a time domain signal to the frequency domain is a filter bank composed of several band-pass filters. The pass band of each filter is relatively narrow, wherein the magnitudes of the signals at the outputs of the filters represent the frequency spectrum of the signal to be transformed.

A lag block 7 determines which preceding sequence of samples best corresponds to the frame to be coded at a given time (block 402). This stage of determining the lag is advantageously conducted in such a way that the lag block 7 compares the values stored in a reference buffer 8 with the samples of the frame to be coded and calculates the error between the samples of the frame to be coded and a corresponding sequence of samples stored in the reference buffer e.g. using a least squares method. Preferably, the sequence of samples composed of successive samples and having the smallest error is selected as a reference sequence of samples.

When the reference sequence of samples is selected from the stored samples by the lag block 7 (block 403), the lag block 7 transfers information concerning it to a coefficient calculation block 9, in order to conduct pitch predictor coefficient evaluation. Thus, in the coefficient calculation block 9, the pitch predictor coefficients b(k) for different pitch predictor orders, such as 1, 3, 5, and 7, are calculated on the basis of the samples in the reference sequence of samples. The calculated coefficients b(k) are then transferred to the pitch predictor block 10. In the flow diagram of FIG. 4, these stages are shown in blocks 405-411. It is obvious that the orders presented here function only as examples clarifying, not restricting the invention. The invention can also be applied with other orders, and the number of orders available can also differ from the total of four orders presented herein.

After the pitch predictor coefficients have been calculated, they are quantized, wherein quantized pitch predictor coefficients are obtained. The pitch predictor coefficients are preferably quantized in such a way that the reconstructed signal produced in the decoder 33 of the receiver corresponds to the original as closely as possible in error-free data transmission conditions. In quantizing the pitch predictor coefficients, it is advantageous to use the highest possible resolution (smallest possible quantization steps) in order to minimize errors caused by rounding.

The stored samples in the reference sequence of samples are transferred to the pitch predictor block 10 where a predicted signal is produced for each pitch predictor order from the samples of the reference sequence, using the calculated and quantized pitch predictor coefficients b(k). Each predicted signal represents the prediction of the signal to be coded, evaluated using the pitch predictor order in question. In the present preferred embodiment of the invention, the predicted signals are further transferred to a second transform block 11, where they are transformed into the frequency domain. The second transform block 11 performs the transformation using two or more different orders, wherein sets of transformed values corresponding to the signals predicted by different pitch predictor orders are produced. The pitch predictor block 10 and the second transform block 11 can be implemented in such a way that they perform the necessary operations for each pitch predictor order, or alternatively a separate pitch predictor block 10 and a separate second transform block 11 can be implemented for each order.

In calculation block 12, the frequency domain transformed values of the predicted signal are compared with the frequency domain transformed representation of the audio signal to be coded, obtained from transform block 6. A prediction error signal is calculated by taking the difference between the frequency spectrum of the audio signal to be coded and the frequency spectrum of the signal predicted using the pitch predictor. Advantageously, the prediction error signal comprises a set of prediction error values corresponding to the difference between the frequency components of the signal to be coded and the frequency components of the predicted signal. A coding error, representing e.g. the average difference between the frequency spectrum of the audio signal and the predicted signal is also calculated. Preferably, the coding error is calculated using a least squares method. Any other appropriate method, including methods based on psychoacoustic modelling of the audio signal, may be used to determine the predicted signal that best represents the audio signal to be coded. A coding efficiency measure (prediction gain) is also calculated in block 12 to determine the information to be transmitted to the transmission channel (block 413). The aim is to minimize the amount of information (bits) to be transmitted (quantitative minimization) as well as the distortions in the signal (qualitative maximization).

In order to reconstruct the signal in the receiver on the basis of preceding samples stored in the receiving device, it is necessary to transmit e.g. the quantized pitch predictor coefficients for the selected order, information concerning the order, the lag, and information about the prediction error to the receiver. Advantageously, the coding efficiency measure indicates whether it is possible to transmit the information necessary to decode the signal encoded in the pitch predictor block 10 with a smaller number of bits than necessary to transmit information relating to the original signal. This determination can be implemented, for example, in such a way that a first reference value is defined, representing the amount of information to be transmitted if the information necessary for decoding is produced using a particular pitch predictor. Additionally, a second reference value is defined, representing the amount of information to be transmitted if the information necessary for decoding is formed on the basis of the original audio signal. The coding efficiency measure is advantageously the ratio of the second reference value to the first reference value. The number of bits required to represent the predicted signal depends on, for example, the order of the pitch predictor (i.e. the number of coefficients to be transmitted), the precision with which each coefficient is represented (quantized), as well as the amount and precision of the error information associated with the predicted signal. On the other hand, the number of bits required to transmit information relating to the original audio signal depends on, for example, the precision of the frequency domain representation of the audio signal.

If the coding efficiency determined in this way is greater than one, it indicates that the information necessary to decode the predicted signal can be transmitted with a smaller number of bits than the information relating to the original signal. In the calculation block 12 the number of bits necessary for the transmission of these different alternatives is determined and the alternative for which the number of bits to be transmitted is smaller is selected (block 414).

According to a first embodiment of the invention, the pitch predictor order with which the smallest coding error is attained is selected to code the audio signal (block 412). If the coding efficiency measure for the selected pitch predictor is greater than 1, the information relating to the predicted signal is selected for transmission. If the coding efficiency measure is not greater than 1, the information to be transmitted is formed on the basis of the original audio signal. According to this embodiment of the invention, emphasis is placed on minimising the prediction error (qualitative maximization).

According to a second advantageous embodiment of the invention, a coding efficiency measure is calculated for each pitch predictor order. The pitch predictor order that provides the smallest coding error, selected from those orders for which the coding efficiency measure is greater than 1, is then used to code the audio signal. If none of the pitch predictor orders provides a prediction gain (i.e. no coding efficiency measure is greater than 1) then advantageously, the information to be transmitted is formed on the basis of the original audio signal. This embodiment of the invention enables a trade-off between prediction error and coding efficiency.

According to a third embodiment of the invention, a coding efficiency measure is calculated for each pitch predictor order and the pitch predictor order that provides the highest coding efficiency, selected from those orders for which the coding efficiency measure is greater than 1, is selected to code the audio signal. If none of the pitch predictor orders provides a prediction gain (i.e. no coding efficiency measure is greater than 1) then advantageously, the information to be transmitted is formed on the basis of the original audio signal. Thus, this embodiment of the invention places emphasis on the maximisation of coding efficiency (quantitative minimization).

According to a fourth embodiment of the invention, a coding efficiency measure is calculated for each pitch predictor order and the pitch order that provides the highest coding efficiency is selected to code the audio signal, even if the coding efficiency is not greater than 1.

Calculation of the coding error and selection of the pitch predictor order is conducted at intervals, preferably separately for each frame, wherein in different frames it is possible to use the pitch predictor order which best corresponds to the properties of the audio signal at a given time.

As explained above, if the coding efficiency determined in block 12 is not greater than one, this indicates that it is advantageous to transmit the frequency spectrum of the original signal, wherein a bit string 501 to be transmitted to the data transmission channel is formed advantageously in the following way (block 415). Information from the calculation block 12 relating to the selected transmission alternative is transferred to selection block 13 (lines D1 and D4 in FIG. 1). In selection block 13 the frequency domain transformed values representing the original audio signal are selected to be transmitted to a quantization block 14. Transmission of the frequency domain transformed values of the original audio signal to quantzation block 14 is illustrated by line A1 in the block diagram of FIG. 1. In the quantization block 14, the frequency domain transformed signal values are quantized in a way known as such. The quantized values are transferred to a multiplexing block 15, in which the bit string to be transmitted is formed. FIGS. 5*a* and 5*b* show an example of a bit string structure which can be advantageously applied in connection with the present invention. Information concerning the selected coding method is transferred from the calculation block 12 to multiplexing block 15 (lines D1 and D3), where the bit string is formed according to the transmission alternative. A first logical value, e.g. the logical 0 state, is used as coding method information 502 to indicate that frequency domain transformed values representing the original audio signal are transmitted in the bit string in question. In addition to the coding method information 502, the values themselves are transmitted in the bit string, quantized to a given accuracy. The field used for transmission of these values is marked with the reference numeral 503 in FIG. 5*a*. The number of values transmitted in each bit string depends on the sampling frequency and on the length of the frame examined at a time. In this situation, pitch predictor order information, pitch predictor coefficients, lag and error information are not transmitted because the signal is reconstructed in the receiver on the basis of the frequency domain values of the original audio signal transmitted in the bit string 501.

If the coding efficiency is greater than one, it is advantageous to encode the audio signal using the selected pitch predictor and the bit string 501 (FIG. 5*b*) to be transmitted to the data transmission channel is formed advantageously in the following way (block 416). Information relating to the selected transmission alternative is transmitted from the calculation block 12 to the selection block 13. This is illustrated by lines D1 and D4 in the block diagram of FIG. 1. In the selection block 13 the quantized pitch predictor coefficients are selected to be transferred to the multiplexing block 15. This is illustrated by line B1 in the block diagram of FIG. 1. It is obvious that the pitch predictor coefficients can also be transferred to the multiplexing block 15 in another way than via the selection block 13. The bit string to be transmitted is formed in the multiplexing block 15. Information concerning the selected coding method is transferred from the calculation block 12 to multiplexing block 15 (lines D1 and D3), where the bit string is formed according to the transmission alternative. A second logical value, e.g. the logical 1 state, is used as coding method information 502, to indicate that said quantized pitch predictor coefficients are transmitted in the bit string in question. The bits of an order field 504 are set according to the selected pitch predictor order. If there are, for example, four different orders available, two bits (00, 01, 10, 11) are sufficient to indicate which order is selected at a given time. In addition, information on the lag is transmitted in the bit string in a lag field 505. In this preferred example, the lag is indicated with 11 bits, but it is obvious that other lengths can also be applied within the scope of the invention. The quantized pitch predictor coefficients are added to the bit string in the coefficient field 506. If the selected pitch predictor order is one, only one coefficient is transmitted, if the order is three, three coefficients are transmitted, etc. The number of bits used in the transmission of the coefficients can also vary in different embodiments. In an advantageous embodiment the first order coefficient is represented with three bits, the third order coefficients with a total of five bits, the fifth order coefficients with a total of nine bits and the seventh order coefficients with ten bits. Generally, it can be stated that the higher the selected order, the larger the number of bits required for transmission of the quantized pitch predictor coefficients.

In addition to the aforementioned information, when the audio signal is encoded on the basis of the selected pitch predictor, it is necessary to transmit prediction error information in an error field 507. This prediction error information is advantageously produced in the calculation block 12 as a difference signal, representing the difference between the frequency spectrum of the audio signal to be coded and the frequency spectrum of the signal that can be decoded (i.e. reconstructed) using the quantized pitch predictor coefficients of the selected pitch predictor in conjunction with the reference sequence of samples. Thus, the error signal is transferred e.g. via the first selection block 13 to the quantization block 14 to be quantized. The quantized error signal is transferred from the quantization block 14 to the multiplexing block 15, where the quantized prediction error values are added to the error field 507 of the bit string.

The encoder 1 according to the invention also includes local decoding functionality. The coded audio signal is transferred from the quantization block 14 to inverse quantization block 17. As described, above, in the situation where the coding efficiency is not greater than 1, the audio signal is represented by its quantized frequency spectrum values. In this case, the quantized frequency spectrum values are transferred to the inverse quantization block 17, where they are inverse quantized in a way known as such, so as to restore the original frequency spectrum of the audio signal as accurately as possible. The inverse quantized values representing the frequency spectrum of the original audio signal are provided as an output from block 17 to summing block 18.

If the coding efficiency is greater than 1, the audio signal is represented by pitch predictor information, e.g. pitch predictor order information, quantized pitch predictor coefficients, a lag value and prediction error information in the form of quantized frequency domain values. As described above, the prediction error information represents the difference between the frequency spectrum of the audio signal to be coded and the frequency spectrum of the audio signal that can be reconstructed on the basis of the selected pitch predictor and the reference sequence of samples. Therefore, in this case, the quantized frequency domain values that comprise the prediction error information are transferred to the inverse quantization block 17, where they are inverse quantized in such a way as to restore the frequency domain values of the prediction error as accurately as possible. Thus, the output of block 17 comprises inverse quantized prediction error values. These values are further provided as an input to summing block 18, where they are summed with the frequency domain values of the signal predicted using the selected pitch predictor. In this way, a reconstructed frequency domain representation of the original audio signal is formed. The frequency domain values of the predicted signal are available from calculation block 12, where they are calculated in connection with determination of the prediction error, and are transferred to summing block 18 as indicated by line C1 in FIG. 1.

The operation of summing block 18 is gated (switched on and off) according to control information provided by calculation block 12. The transfer of control information enabling this gating operation is indicated by the link between calculation block 12 and summing block 18 (lines D1 and D2 in FIG. 1). The gating operation is necessary in order to take into account the different types of inverse quantized frequency domain values provided by inverse quantization block 17. As described above, if the coding efficiency is not greater than 1, the output of block 17 comprises inverse quantized frequency domain values representing the original audio signal. In this case no summing operation is necessary and no information regarding the frequency domain values of any predicted audio signal, constructed in calculation block 12, is required. In this situation, the operation of summing block 18 is inhibited by the control information supplied from calculation block 12 and the inverse quantized frequency domain values representing the original audio signal pass through summing block 18. On the other hand, if the coding efficiency is greater than 1, the output of block 17 comprises inverse quantized prediction error values. In this case, it is necessary to sum the inverse quantised prediction error values with the frequency spectrum of the predicted signal in order to form a reconstructed frequency domain representation of the original audio signal. Now, the operation of summing block 18 is enabled by the control information transferred from calculation block 12, causing the inverse quantised prediction error values to be summed with the frequency spectrum of the predicted signal. Advantageously, the necessary control information is provided by the coding method information produced in block 12 in connection with the choice of coding to be applied to the audio signal.

In an alternative embodiment quantization can be performed before the calculation of prediction error and coding efficiency values, wherein prediction error and coding efficiency calculations are performed using quantized frequency domain values representing the original signal and the predicted signals. Advantageously the quantization is performed in quantization blocks positioned in between blocks 6 and 12 and blocks 11 and 12 (not shown). In this embodiment quantization block 14 is not required, but an additional inverse quantization block is required in the path indicated by line C1.

The output of summing block 18 is sampled frequency domain data that corresponds to the coded sequence of samples (audio signal). This sampled frequency domain data is further transformed to the time domain in an inverse modified DCT transformer 19 from which the decoded sequence of samples is transferred to the reference buffer 8 to be stored and used in connection with the coding of subsequent frames. The storage capacity of the reference buffer 8 is selected according to the number of samples necessary to attain the coding efficiency demands of the application in question. In the reference buffer 8, a new sequence of samples is preferably stored by over-writing the oldest samples in the buffer, i.e. the buffer is a so-called circular buffer.

The bit string formed in the encoder 1 is transferred to a transmitter 16, in which modulation is performed in a way known as such. The modulated signal is transferred via the data transmission channel 3 to the receiver e.g. as radio frequency signals. Advantageously, the coded audio signal is transmitted frame by frame, substantially immediately after encoding for a given frame is complete. Alternatively, the audio signal may be encoded, stored in the memory of the transmitting terminal and transmitted at some later time.

In a receiving device 31, the signal received from the data transmission channel is demodulated in a way known as such in a receiver block 20. The information contained in the demodulated data frame is determined in the decoder 33. In a demultiplexing block 21 of the decoder 33 it is first examined, on the basis of the coding method information 502 of the bit string, whether the received information was formed on the basis of the original audio signal. If the decoder determines that the bit string 501 formed in the encoder 1 does not contain the frequency domain transformed values of the original signal, decoding is advantageously conducted in the following way. The order M to be used in the pitch predictor block 24 is determined from the order field 504 and the lag is determined from the lag field 505. The quantized pitch predictor coefficients received in the coefficient field 506 of the bit string 501, as well as information concerning the order and the lag are transferred to the pitch predictor block 24 of the decoder. This is illustrated by line B2 in FIG. 2. The quantized values of the prediction error signal, received in field 507 of the bit string are inverse quantized in an inverse quantization block 22 and transferred to a summing block 23 of the decoder. On the basis of the lag information, the pitch predictor block 24 of the decoder retrieves the samples to be used as a reference sequence from a sample buffer 28, and performs a prediction according to the selected order M, in which the pitch predictor block 24 utilizes the received pitch predictor coefficients. Thereby, a first reconstructed time domain signal is produced, which is transformed into the frequency domain in a transform block 25. This frequency domain signal is transferred to the summing block 23, wherein a frequency domain signal is produced as a sum of this signal and the inverse quantized prediction error signal. Thus, in error-free data transmission conditions, the reconstructed frequency domain signal substantially corresponds to the original coded signal in the frequency domain. This frequency domain signal is transformed to the time domain by means of an inverse modified DCT transform in a inverse transform block 26, wherein a digital audio signal is present at the output of the inverse transform block 26. This signal is converted to an analog signal in a digital/analog converter 27, amplified if necessary and transmitted to other further processing stages in a way known as such. In FIG. 3, this is illustrated by audio block 32.

If the bit string 501 formed in the encoder 1 comprises the values of the original signal transformed into the frequency domain, decoding is advantageously conducted in the following way. The quantized frequency domain transformed values are inverse quantized in the inverse quantization block 22 and transferred via the summing block 23 to the inverse transform block 26. In the inverse transform block 26 the frequency domain signal is transformed to the time domain by means of an inverse modified DCT transform, wherein a time domain signal corresponding to the original audio signal is produced in digital format. If necessary, this signal is transformed into an analog signal in the digital/analog converter 27.

In FIG. 2, reference A2 illustrates the transmission of control information to the summing block 23. This control information is used in a manner analogous to that described in connection with the local decoder functionality of the encoder. In other words, if the coding method information provided in field 502 of a received bit string 501 indicates that the bit string contains quantized frequency domain values derived from the audio signal itself, the operation of summing block 23 is inhibited. This allows the quantized frequency domain values of the audio signal to pass through summing block 23 to inverse transform block 26. On the other hand, if the coding method information retrieved from field 502 of a received bit string indicates that the audio signal was encoded using a pitch predictor, the operation of summing block 23 is enabled, allowing inverse quantised prediction error data to be summed with the frequency domain representation of the predicted signal produced by transform block 25.

In the example of FIG. 3, the transmitting device is a wireless communication device 2 and the receiving device is a base station 31, wherein the signal transmitted from the wireless communication device 2 is decoded in the decoder 33 of the base station 31, from which the analog audio signal is transmitted to further processing stages in a way known as such.

It is obvious that in the present example, only the features most essential for applying the invention are presented, but in practical applications the data transmission system also comprises functions other than those presented herein. It is also possible to utilize other coding methods in connection with the coding according to the invention, such as short-term prediction. Furthermore, when transmitting the signal coded according to the invention, other processing steps can be performed, such as channel coding.

It is also possible to determine the correspondence between the predicted signal and the actual signal in the time domain. Thus, in an alternative embodiment of the invention, it is not necessary to transform the signals to the frequency domain, wherein the transform blocks 6, 11 are not necessarily required, and neither are the inverse transform block 19 of the coder as well as the transform block 25 and the inverse transform block 26 of the decoder. The coding efficiency and the prediction error are thus determined on the basis of time domain signals.

The previously described audio signal coding/decoding stages can be applied in different kinds of data transmission systems, such as mobile communication systems, satellite-TV systems, video on demand systems, etc. For example, a mobile communication system in which audio signals are transmitted in full duplex requires an encoder/decoder pair both in the wireless communication device 2 and in the base station 31 or the like. In the block diagram of FIG. 3, corresponding functional blocks of the wireless communication device 2 and the base station 31 are primarily marked with the same reference numerals. Although the encoder 1 and the decoder 33 are shown as separate units in FIG. 3, in practical applications they can be implemented in one unit, a so-called codec, in which all the functions necessary to perform encoding and decoding are implemented. If the audio signal is transmitted in digital format in the mobile communication system, analog/digital conversion and digital/analog conversion, respectively, are not necessary in the base station. Thus, these transformations are conducted in the wireless communication device and in the interface via which the mobile communication network is connected to another telecommunication network, such as a public telephone network. If this telephone network, however, is a digital telephone network, these transformations can also be made e.g. in a digital telephone (not shown) connected to such a telephone network.

The previously described encoding stages are not necessarily conducted in connection with transmission, but the coded information can be stored for later transmission. Furthermore, the audio signal applied to the encoder does not necessarily have to be a real-time audio signal, but the audio signal to be coded can be information stored earlier from the audio signal.

In the following, the different coding stages according to an advantageous embodiment of the invention are described mathematically. The transfer function of the pitch predictor block has the form:

$$B(z) = \sum_{k=-m_1}^{m_2} b(k) z^{-(\alpha+k)} \tag{1}$$

where $\alpha$ is the lag, b(k) are the coefficients of the pitch predictor, and $m_1$ and $m_2$ are dependent on the order (M), advantageously in the following way:

$$m_1=(M-1)/2$$

$$m_2=M-m1-1$$

Advantageously, the best corresponding sequence of samples (i.e. the reference sequence) is determined using the least squares method. This can be expressed as:

$$E = \sum_{i=0}^{N-1}\left(x(i) - \sum_{j=-m_1}^{m_2} b(j)\tilde{x}(i+j-\alpha)\right)^2 \tag{2}$$

where E=error, x( ) is the input signal in the time domain, $\tilde{x}$( ) is the signal reconstructed from the preceding sequence of samples and N is the number of samples in the frame examined. The lag a can be calculated by setting the variable $m_1=0$ and $m_2=0$ and solving b from equation 2. Another alternative for solving the lag $\alpha$ is to use the normalized correlation method, by utilizing the formula:

$$\alpha = \max_{lag}\left\{\frac{\sum_{i=0}^{N-1}(x(i)\tilde{x}(i-lag))}{\sqrt{\sum_{i=0}^{N-1}\tilde{x}(i-lag)^2}}, lag = startlag, \ldots, endlag\right\} \tag{3}$$

When the best corresponding (reference) sequence of samples has been found, the lag block 7 has information about the lag, i.e. how much earlier the corresponding sequence of samples appeared in the audio signal.

The pitch predictor coefficients b(k) can be calculated for each order M from equation (2), which can be re-expressed in the form:

$$E = \sum_{i=0}^{N-1} x(i)^2 - 2\cdot\sum_{i=0}^{N-1} x(i)\sum_{j=-m_1}^{m_2} b(j)\tilde{x}(i+j-\alpha) + \sum_{i=0}^{N-1}\left(\sum_{j=-m_1}^{m_2} b(j)\tilde{x}(i+j-\alpha)\right)^2 \tag{4}$$

The optimum value for the coefficients b(k) can be determined by searching for a coefficient b(k) for which the change in the error with respect to b(k) is as small as possible. This can be calculated by setting the partial derivative of the error relationship with respect to b to zero ($\partial E/\partial b=0$) wherein the following formula is attained:

$$-2\cdot\sum_{i=0}^{N-1} x(i)\sum_{j=-m_1}^{m_2}\tilde{x}(i+j-\alpha) + 2\cdot\sum_{i=0}^{N-1}\left[\left(\sum_{j=-m_1}^{m_2} b(j)\tilde{x}(i+j-\alpha)\right)\sum_{j=-m_1}^{m_2}\tilde{x}(i+j-\alpha)\right] = 0 \tag{5}$$

$$\text{i.e.: } \sum_{i=0}^{N-1}\left[\sum_{j=-m_1}^{m_2} b(j)\tilde{x}(i+j-\alpha)\cdot\sum_{j=-m_1}^{m_2}\tilde{x}(i+j-\alpha)\right] = \sum_{i=0}^{N-1} x(i)\sum_{j=-m_1}^{m_2}\tilde{x}(i+j-\alpha)$$

This equation can be written in matrix format, wherein the coefficients b(k) can be determined by solving the matrix equation:

$$\bar{b}=\bar{A}^{-1}\cdot\bar{r}$$

where $$\bar{b} = \begin{bmatrix} b_{-m_1} \\ b_{-m_1+1} \\ \vdots \\ b_{m_2} \end{bmatrix}, \bar{r} = \begin{bmatrix} \sum_{i=0}^{N-1} x(i)\tilde{x}(i-m_1-\alpha) \\ \vdots \\ \sum_{i=0}^{N-1} x(i)\tilde{x}(i+m_2-\alpha) \end{bmatrix},$$

$$\bar{A} = \begin{bmatrix} \sum_{i=0}^{N-1}\tilde{x}(i-m_1-\alpha)\tilde{x}(i-m_1-\alpha) & \cdots & \sum_{i=0}^{N-1}\tilde{x}(i-m_1-\alpha)\tilde{x}(i+m_2-\alpha) \\ \vdots & \ddots & \vdots \\ \sum_{i=0}^{N-1}\tilde{x}(i+m_2-\alpha)\tilde{x}(i-m_1-\alpha) & \cdots & \sum_{i=0}^{N-1}\tilde{x}(i+m_2-\alpha)\tilde{x}(i+m_2-\alpha) \end{bmatrix}$$

In the method according to the invention, the aim is to utilize the periodicity of the audio signal more effectively than in systems according to prior art. This is achieved by increasing the adaptability of the encoder to changes in the frequency of the audio signal by calculating pitch predictor coefficients for several orders. The pitch predictor order used to code the audio signal can be chosen in such a way as to minimise the prediction error, to maximise the coding efficiency or to provide a trade-off between prediction error and coding efficiency. The selection is performed at certain intervals, preferably independently for each frame. The order and the pitch predictor coefficients can thus vary on a frame-by-frame basis. In the method according to the invention, it is thus possible to increase the flexibility of the coding when compared to coding methods of prior art using a fixed order. Furthermore, in the method according to the invention, if the amount of information (number of bits) to be transmitted for a given frame cannot be reduced by means of coding, the original signal, transformed into the frequency domain, can be transmitted instead of the pitch predictor coefficients and the error signal.

The previously presented calculation procedures used in the method according to the invention, can be advantageously implemented in the form of a program, as program codes of the controller 34 in a digital signal processing unit or the like, and/or as a hardware implementation. On the basis of the above description of the invention, a person skilled in the art is able to implement the encoder 1 according to the invention, and thus it is not necessary to discuss the different functional blocks of the encoder 1 in more detail in this context.

To transmit said pitch predictor coefficients to the receiver, it is possible to use so-called look-up tables. In such a look-up table different coefficient values are stored, wherein instead of the coefficient, the index of this coefficient in the look-up table is transmitted. The look-up table is known to both the encoder 1 and the decoder 33. At the reception stage it is possible to determine the pitch predictor coefficient in question on the basis of the transmitted index by using the look-up table. In some cases the use of the look-up table can reduce the number of bits to be transmitted when compared to the transmission of pitch predictor coefficients.

The present invention is not restricted to the embodiments presented above, neither is it restricted in other respects, but it can be modified within the scope of the appended claims.

The invention claimed is:

1. A method for coding an audio signal comprising at least the following:

examining a part of the audio signal to be coded to find another part of the audio signal which substantially corresponds to the part of the audio signal to be coded, producing a set of predicted signals on the basis of the substantially corresponding part of the audio signal using a set of pitch predictor orders, determining a coding efficiency for at least two of said predicted signals by using information indicative of said part of the audio signal to be coded, using the determined coding efficiency to select a coding method for the part of the audio signal to be coded, and using the determined coding efficiency to select a pitch predictor order for the selected coding method by comparing the coding efficiencies determined for said at least two predicted signals and selecting the pitch predictor order which produces the highest coding efficiency, when the audio signal is coded on the basis of a predicted signal in the selected coding method.

2. The method according to claim 1, characterized in that the selectable coding methods comprise a method in which the audio signal to be coded is coded on the basis of a predicted signal.

3. The method according to claim 2, characterized in that the selectable coding methods comprise a method in which the audio signal to be coded is coded on the basis of the audio signal itself.

4. The method according to claim 1, characterized in that a coding error is determined for each of said predicted signals.

5. The method according to claim 4, characterized in that the coding efficiency is defined for the predicted signal having the smallest said coding error, and that the coding is performed on the basis of the predicted signal having the smallest said coding error if the determined coding efficiency information indicates that the amount of coded information is less than if the coding is performed on the basis of the part of the audio signal to be coded.

6. The method according to claim 5, characterized in that the part of audio signal to be coded is transformed into the frequency domain to determine the frequency spectrum of the audio signal, and each predicted signal is transformed into the frequency domain to determine the frequency spectrum of each predicted signal, and that said coding efficiency is determined for said predicted signal having the smallest coding error on the basis of the frequency spectrum of the audio signal, and the frequency spectrum of the predicted signal.

7. The method according to claim 1, characterized in that a coding efficiency is determined for each of said predicted signals and a coding error is determined for those predicted signals for which the determined coding efficiency information indicates that the amount of coded information is less than if the coding is performed on the basis of the part of the audio signal to be coded and the coding is performed on the basis of the predicted signal that provides the smallest coding error.

8. The method according to claim 1, characterized in that a coding efficiency is determined for each of said predicted signals and the coding is performed on the basis of the predicted signal that provides the highest coding efficiency, if the determined coding efficiency information indicates that the amount of coded information is less than if the coding is performed on the basis of the part of the audio signal to be coded.

9. The method according to claim 1, characterized in that a coding efficiency is determined for each of said predicted signals and the coding is performed on the basis of the predicted signal that provides the highest coding efficiency.

10. The method according to claim 7, characterized in that the part of audio signal to be coded is transformed into the frequency domain to determine the frequency spectrum of the audio signal, and each predicted signal is transformed into the frequency domain to determine the frequency spectrum of each predicted signal, and that said coding efficiency is determined for each predicted signal on the basis of the frequency spectrum of the audio signal, and the frequency spectrum of the predicted signal.

11. The method according to claim 5, characterized in that prediction error information is determined for each of said predicted signals.

12. The method according to claim 5, characterized in that said predicted signals are formed by using a different prediction order for each of said predicted signals.

13. The method according to claim 6, characterized in that said prediction error information determined for each of said predicted signals is calculated as a difference spectrum representing using said frequency spectrum of the audio signal and the frequency spectrum of the predicted signal.

14. The method according to claim 10, characterized in that the transformation to the frequency domain is conducted using a modified DCT transform.

15. The method according to claim 1, characterized in that the coded information (501) of the predicted signal comprises at least data relating to the coding method (502), data relating to the selected order (504), a lag (505), pitch predictor coefficients (506) and data relating to the prediction error (507).

16. The method according to claim 1, characterized in that the audio signal is divided into frames, wherein the coding is performed separately for each frame formed from the audio signal.

17. The method according to claim 1, characterized in that the audio signal is a speech signal.

18. The method according to claim 4, characterized in that said coding error is determined using one of the following:

at least squares method;

a method based on psychoacoustic modelling of the audio signal to be coded.

19. The method according to claim 18, characterized in that if said coding error is determined using the least squares method, the coding error is calculated from the prediction error.

20. The method according to claim 1, characterized in that said coded audio signal is transmitted to a receiving device.

21. A data transmission system comprising:

means for coding an audio signal, means for examining a part of the audio signal to be coded to find another part of the audio signal which substantially corresponds to the part of the audio signal to be coded, means for using a set of pitch predictor orders to produce a set of predicted signals on the basis of the substantially corresponding part of the audio signal, means for determining a coding efficiency for at least two of said predicted signals by using information indicative of said part of the audio signal to be coded, means for using the determined coding efficiency to select a coding method for the part of the audio signal to be coded, means for using the determined coding efficiency to select a pitch predictor order for the selected coding method by comparing the coding efficiencies determined for said at least two predicted signals and selecting the pitch predictor order which produces the highest coding efficiency when the audio signal is coded on the basis of a predicted signal in the selected coding method, and means for transmitting the coded audio signal.

22. The data transmission system according to claim 21, characterized in that it comprises means for determining a coding error for at least one of said predicted signals.

23. The data transmission system according to claim 21, characterized in that it comprises means for transforming the part of audio signal to be coded into the frequency domain, and means for transforming each predicted signal into the frequency domain.

24. The data transmission system according to claim 21, characterized in that it comprises means to form a bit string (15) for transmission to a receiving device, said bit string comprising at least information concerning the selected coding method.

25. The data transmission system according to claim 21, characterized in that it comprises means for dividing the audio signal into frames.

26. The data transmission system according to claim 21, characterized in that it comprises a mobile terminal.

27. An encoder comprising:

means for coding an audio signal means for examining a part of the audio signal to be coded to find another part of the audio signal which substantially corresponds to the part of the audio signal to be coded, means for using a set of pitch predictor orders to produce a set of predicted signals on the basis of the substantially corresponding part of the audio signal, means for determining a coding efficiency for at least two of said predicted signals by using information indicative of said part of the audio signal to be coded, means for using the determined coding efficiency to select a coding method for the part of the audio signal to be coded, and means for using the determined coding efficiency to select a pitch predictor order for the selected coding method by comparing the coding efficiencies determined for said at least two predicted signals and selecting the pitch predictor order which produces the highest coding efficiency when the audio signal is coded on the basis of a predicted signal in the selected coding method.

28. The encoder (1) according to claim 27, characterized in that it comprises means (4, 6-14) to code the audio signal on the basis of a predicted signal.

29. The encoder (1) according to claim 28, characterized in that it comprises means (4, 6, 14) to coder the audio signal itself.

30. A decoder (33) for decoding an audio signal coded in a encoder according to claim 27, characterized in that the decoder comprises means for determining the coding method of the audio signal to be decoded, and means for decoding the audio signal according to the determined coding method.

31. A decoder according to claim 30, characterized in that the decoder comprises means (21) for receiving information relating to a predicted signal.

32. A decoder according to claim 31, characterized in that the decoder comprises means (24, 28) for producing a predicted signal on the basis of the received information.

33. A decoder according to claim 31, characterized in that the decoder comprises means (21) for determining from said received information at least data relating to a selected order (504), a lag (505), at least one pitch predictor coefficient (506) and prediction error data (507).

34. A decoder according to claim 33, characterized in that it comprises means (24, 28) for producing a predicted signal using said data relating to a selected order (504), a lag (505), and at least one pitch predictor coefficient (506).

35. A decoder according to claim 33, characterized in that it comprises means (23, 24, 28) for producing a reconstructed audio signal using said predicted signal and said prediction error data.

36. A decoder according to claim 30, characterized in that it comprises means (21) for receiving information relating to the audio signal itself.

37. A decoder according to claim 36, characterized in that it comprises means (22, 23, 26) for producing a reconstructed audio signal using said received information relating to the audio signal itself.

38. A method for decoding an audio signal which is coded according to the method of claim 1, characterized in that the coding method of the audio signal to be decoded is determined, and the decoding is performed according to the determined coding method of the audio signal.

39. A method according to the claim 38, characterized in that the coding method is one of the following alternatives:

A method in which the audio signal is coded using a pitch predictor of a given order, A method in which the audio signal is coded on the basis of the audio signal itself.

40. A method for coding an audio signal comprising at least the following:

examining a part of the audio signal to be coded to find another part of the audio signal which substantially corresponds to the part of the audio signal to be coded, producing a set of predicted signals on the basis of the substantially corresponding part of the audio signal using a set of pitch predictor orders, determining a coding efficiency for at least two of said predicted signals by using information indicative of said part of the audio signal to be coded, using the determined coding efficiency to select a coding method for the part of the audio signal to be coded, determining a coding error for said at least two of said predicted signals, using the determined coding error to select a pitch predictor order for the selected coding method, by comparing the coding errors determined for said at least two predicted signals and selecting the pitch predictor order which produces the smallest coding error, when the audio signal is coded on the basis of a predicted signal in the selected coding method.

41. A method for coding an audio signal comprising at least the following:

examining a part of the audio signal to be coded to find another part of the audio signal which substantially corresponds to the part of the audio signal to be coded, producing a set of predicted signals on the basis of the substantially corresponding part of the audio signal using a set of pitch predictor orders, determining a coding efficiency for at least two of said predicted signals by using information indicative of said part of the audio signal to be coded, using the determined coding efficiency to select a coding method for the part of the audio signal to be coded, determining a prediction error for said at least two of said predicted signals, using the determined prediction error to select a pitch predictor order for the selected coding method, by comparing the prediction errors determined for said at least two predicted signals and selecting the pitch predictor order which produces the smallest prediction error, when the audio signal is coded on the basis of a predicted signal in the selected coding method.

42. A method for coding an audio signal comprising at least the following:

examining a part of the audio signal to be coded to find another part of the audio signal which substantially corresponds to the part of the audio signal to be coded, producing a set of predicted signals on the basis of the substantially corresponding part of the audio signal using a set of pitch predictor orders, determining a coding efficiency for at least two of said predicted signals by using information indicative of said part of the audio signal to be coded, and using the determined coding efficiency to select a pitch predictor order for the selected coding method, by comparing the coding efficiencies determined for said at least two predicted signals and selecting the pitch predictor order which produces the highest coding efficiency.

43. An encoder comprising:

means for coding an audio signal, means for examining a part of the audio signal to be coded to find another part of the audio signal which substantially corresponds to the part of the audio signal to be coded, means for using a set of pitch predictor orders to produce a set of predicted signals on the basis of the substantially corresponding part of the audio signal, means for determining a coding efficiency for at least two of said predicted signals by using information indicative of said part of the audio signal to be coded, means for using the determined coding efficiency to select a coding method for the part of the audio signal to be coded, and means for using the determined coding efficiency to select a pitch predictor order for the selected coding method by comparing the coding efficiencies determined for said at least two predicted signals and selecting the pitch predictor order which produces the highest coding efficiency when the audio signal is coded on the basis of a predicted signal in the selected coding method.

44. The encoder according to claim 43 comprising:

means for calculating a reference value for each said at least two of said predicted signals indicative of the coding efficiency of the respective pitch predictor order; and means for comparing said reference values with each other;

wherein said means for using the determined coding efficiency are adapted to select the pitch predictor order on the basis of the smallest reference value.

45. An encoder comprising:

means for coding an audio signal, means for examining a part of the audio signal to be coded to find another part of the audio signal which substantially corresponds to the part of the audio signal to be coded, means for using a set of pitch predictor orders to produce a set of predicted signals on the basis of the substantially corresponding part of the audio signal, means for determining a coding efficiency for at least two of said predicted signals by using information indicative of said part of the audio signal to be coded, means for using the determined coding efficiency to select a coding method for the part of the audio signal to be coded, means for determining a coding error for said at least two of said predicted signals, and means for using the determined coding error to select a pitch predictor order for the selected coding method by comparing the coding errors determined for said at least two predicted signals and selecting the pitch predictor order which produces the smallest coding error when the audio signal is coded on the basis of a predicted signal in the selected coding method.

46. An encoder comprising:

means for coding an audio signal, means for examining a part of the audio signal to be coded to find another part of the audio signal which substantially corresponds to the part of the audio signal to be coded, means for using a set of pitch predictor orders to produce a set of predicted signals on the basis of the substantially corresponding part of the audio signal, means for determining a coding efficiency for at least two of said predicted signals by using information indicative of said part of the audio signal to be coded, means for using the determined coding efficiency to select a coding method for the part of the audio signal to be coded, means for determining a prediction error for said at least two of said predicted signals, and means for using the determined prediction error to select a pitch predictor order for the selected coding method by comparing the prediction errors determined for said at least two predicted signals and selecting the pitch predictor order which produces the smallest prediction error when the audio signal is coded on the basis of a predicted signal in the selected coding method.

47. An encoder comprising:

means for coding an audio signal, means for examining a part of the audio signal to be coded to find another part of the audio signal which substantially corresponds to the part of the audio signal to be coded, means for using a set of pitch predictor orders to produce a set of predicted signals on the basis of the substantially corresponding part of the audio signal, means for determining a coding efficiency for at least two of said predicted signals by using information indicative of said part of the audio signal to be coded, means for using the determined coding efficiency to select a pitch predictor order for the selected coding method by comparing the coding efficiencies determined for said at least two predicted signals and selecting the pitch predictor order which produces the highest coding efficiency, when the audio signal is coded on the basis of a predicted signal in the selected coding method.

48. A decoder for decoding a signal encoded by an encoder, the encoder having:

means for examining a first part of an audio signal to be coded to find a second part of the audio signal substantially corresponding to the first part of the audio signal, means for using a set of pitch predictor orders to produce a set of predicted signals on the basis of the second part of the audio signal, means for determining a coding efficiency for at least a plurality of the predicted signals by using information indicative of the first part of the audio signal, means for using the determined coding efficiency to select a coding method for the first part of the audio signal, means for using the determined coding efficiency to select a pitch predictor order for the selected coding method, and a coder for coding the first part of the audio signal using the selected coding method and pitch predictor order, wherein the decoder includes:

decoding circuitry operable to determine the selected coding method and selected pitch predictor order and decode the coded audio signal accordingly.

49. The decoder of claim 48, wherein the determined coding efficiency is used to select the pitch predictor order by selecting the pitch predictor order which produces the highest coding efficiency when the first part of the audio signal is coded on the basis of one of the plurality of predicted signals in the selected coding method.

50. A decoder for decoding a signal encoded by an encoder, the encoder having:

means for examining a first part of the audio signal to be coded to find a second part of the audio signal substantially corresponding to the first part of the audio signal, means for using a set of pitch predictor orders to produce a set of predicted signals on the basis of the second part of the audio signal, means for determining a coding efficiency for at least a plurality of the predicted signals by using information indicative of the first part of the audio signal, means for using the determined coding efficiency to select a coding method for the first part of the audio signal, means for determining a coding error for the plurality of predicted signals, means for using the determined coding error to select a pitch predictor order for the selected coding method, and a coder for coding the first part of the audio signal using the selected coding method and pitch predictor order, wherein the decoder includes:

decoding circuitry operable to determine the selected coding method and selected pitch predictor order and decode the coded audio signal accordingly.

51. The decoder of claim 50, wherein the determined coding error is used to select the pitch predictor order by selecting the pitch predictor order which produces the smallest coding error when the first part of the audio signal is coded on the basis of one of the plurality of predicted signals in the selected coding method.

52. A decoder for decoding a signal encoded by an encoder, the encoder having:

means for examining a first part of the audio signal to be coded to find a second part of the audio signal substantially corresponding to the first part of the audio signal, means for using a set of pitch predictor orders to produce a set of predicted signals on the basis of the second part of the audio signal, means for determining a coding efficiency for at least a plurality of the predicted signals by using information indicative of the first part of the audio signal, means for using the determined coding efficiency to select a coding method for the first part of the audio signal, means for determining a prediction error for said at least two of said predicted signals, means for using the determined prediction error to select a pitch predictor order for the selected coding method, and a coder for coding the first part of the audio signal using the selected coding method and pitch predictor order, wherein the decoder includes:

decoding circuitry operable to determine the selected coding method and selected pitch predictor order and decode the coded audio signal accordingly.

53. The decoder of claim 52, wherein the determined prediction error is used to select the pitch predictor order by selecting the pitch predictor order which produces the smallest prediction error when the first part of the audio signal is coded on the basis of one of the plurality of predicted signals in the selected coding method.

54. A decoder for decoding a signal encoded by an encoder, the encoder having:

means for examining a first part of the audio signal to be coded to find a second part of the audio signal substantially corresponding to the first part of the audio signal, means for using a set of pitch predictor orders to produce a set of predicted signals on the basis of the second part of the audio signal, means for determining a coding efficiency for at least a plurality of the predicted signals by using information indicative of the first part of the audio signal, means for using the determined coding efficiency to select a pitch predictor order for a selected coding method by comparing the coding efficiencies determined for the plurality of predicted signals and selecting the pitch predictor order which produces the highest coding efficiency, and a coder for coding the first part of the audio signal using the selected coding method and pitch predictor order, wherein the decoder includes:

decoding circuitry operable to determine the selected coding method and selected pitch predictor order and decode the coded audio signal accordingly.

* * * * *